United States Patent [19]

Ohashi

[11] Patent Number: 4,774,644

[45] Date of Patent: Sep. 27, 1988

[54] STRUCTURE FOR MOUNTING ELECTRIC BULB IN PORTABLE FLASHLIGHT

[75] Inventor: Keiichi Ohashi, Shizuoka, Japan

[73] Assignee: Skylite Industry Co., Ltd., Shizuoka, Japan

[21] Appl. No.: 878,653

[22] Filed: Jun. 26, 1986

[51] Int. Cl.[4] ..... F21L 15/00

[52] U.S. Cl. ..... 362/208; 362/202; 439/672

[58] Field of Search ..... 339/17 D, 59 L, 61 L, 339/119, 128, 176 L; 313/318; 362/202, 208, 226, 296; 439/672

[56] References Cited

U.S. PATENT DOCUMENTS

| | | | |
|---|---|---|---|
| 1,955,285 | 4/1934 | Graham | 439/672 |
| 2,869,097 | 1/1959 | Stuart | 339/69 |
| 3,998,519 | 12/1976 | Martin | 339/258 R |
| 4,255,010 | 3/1981 | Jullien | 339/176 L |
| 4,570,208 | 2/1986 | Sassmannshausen | 362/188 |

*Primary Examiner*—Samuel Scott
*Assistant Examiner*—Allen J. Flanigan
*Attorney, Agent, or Firm*—Wegner & Bretschneider

[57] ABSTRACT

In a flashlight, the bulb is attached to a bulb-holding frame within the body of the flashlight instead of to the reflector. The bulb-holding frame has a mounting member with an inner diameter larger than the base of the bulb but smaller than a flange formed on the bulb. A locking hook extends from the mounting member and cooperates with a notch formed in flange so as to connect the bulb to the bulb-holding frame.

8 Claims, 3 Drawing Sheets

STRUCTURE FOR MOUNTING ELECTRIC BULB IN PORTABLE FLASHLIGHT

FIELD OF THE INVENTION

The present invention relates to a structure for mounting an electric bulb (hereinafter referred simply to as the bulb), and is especially concerned with an arrangement characterized in that the bulb is mounted to a cell holder frame.

STATEMENT OF THE PRIOR ART

A portable flashlight makes use of two or more dry cells as the power source, and comprises a body, a light source unit, a switch and other parts. The body contains therein dry cells, and the light source unit has a parabolic reflector and a bulb of small size attached thereto in such a manner that light emitting from the bulb is converged ahead for illumination.

Referring to the prior art portable flashlights, a bulb 31 has been attached to a reflector 32, as dislcosed in, e.g., Japanese Utility Model Laid-Open No. 54-128391 and Japanese Patent Application No. 60-271141 specification, and as illustrated in FIG. 4. For that reason, the conventional portable flashlight has needed attachment of a fitting 33 for supporting the bulb 31 to the reflector 32 and a socket 34 for securing the bulb 31 to the support fitting 33. From the standpoint of flashlight makers, on the one hand, this has resulted in increases in the number of parts and assembling steps involved and hence in the production cost. From the standpoint of users, on the other hand, this has led to the disadvantage that, when the used-up bulb 31 is replaced by a new bulb, the bulb and the socket 34, etc. may be lost. In addition, there has been a connection made between a flange 35 for the bulb 31 and a ground fitting 37 of a cell holder frame 36 through the support fitting 33; this tends to increase the number of contact portions, and leads to the possibility of unsatisfactory contact.

SUMMARY OF THE INVENTION

With the foregoing disadvantages in mind, a primary object of the present invention is to provide an improved portable flashlight which is of simplified structure, allows ready attachment or detachment of a bulb, and provides assured connection of the bulb with respect to a ground fitting.

According to the present invention, this object is achieved by provision of a structure for mounting a bulb in a portable flashlight including a body to receive therein dry cells and a cell holder frame, a light source unit on the front portion and an on-off switch on a suitable portion, wherein a flange for a bulb is notched out on its one or more positions, a reflector of said light source unit is provided with an insertion hole on the central portion, said cell holder frame is formed at a position corresponding to said insertion hole with a mounting member having an inner diameter slightly larger than the outer diameter of a base of said bulb but smaller than the outer diameter of said flange, and a locking hook is mounted at a position slightly projecting from a front end face of said mounting member, said locking hook being formed by bending inwardly an end portion of an earth fitting.

Many other advantages, features and additional objects of the present invention will become apparent to those versed in the art upon making reference to the detailed description and the accompanying sheet of the drawings on which preferred structural embodiments incorporating the principles of the present invention are shown by way of illustrative example.

DETAILED EXPLANATION OF THE PREFERRED EMBODIMENT

Figure 1:
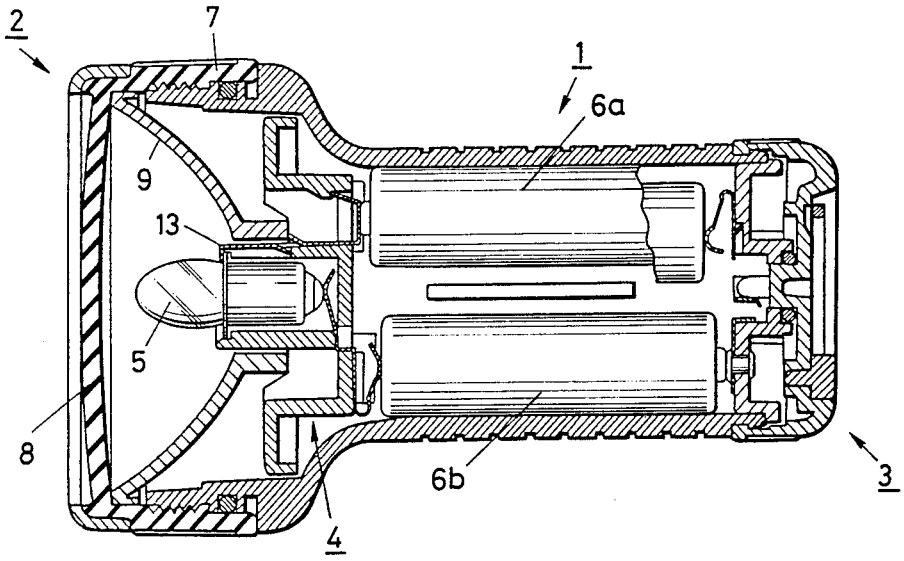
FIG. 1 is a longitudinal side view illustrating one embodiment of the present invention.

Referring to the drawings, there is shown one preferred embodiment wherein the present invention is typically applied to a small-sized portable flashlight having four dry cells, which comprises a body 1, a light source unit 2, a switch 3 and a cell holder frame 4. Basically, such an arrangement is similar to the prior art arrangement, except that the bulb 5 is designed to be attachable to the cell holder frame 4, not to the light source unit 2. More specifically, the body 1 forms a main part of the portable flashlight having therein a dry cell assembly 6 and a cell holder frame 4 which is provided to fix that assembly 6 in place and defines a portion of an electric circuit for connecting that assembly 6 to the bulb 5. The body 1 is then adapted to be open on the front face for attachment of the light source unit 2, and is provided with the switch 3 for turning on or off the bulb 5 located on a suitable portion (at the rear end in the case of the portable flashlight illustrated). The light source unit 2 is comprised of a frame 7 for attachment to the body 1, a lens 8 and a parabolic relfector 9. It is to be understood that, while the aforesaid members or parts are substantially identical with those used in the prior art, the reflector 9 is only provided on the central portion with a hole for insertion of a mounting cylindrical member 11 to be described later, but without any support means.

At a position corresponding to the insertion hole in the reflector 9, the cell holder frame 4 is provided with the mounting member 11 in cylindrical form, at one end of which a locking hook 13 is to be positioned, whereby the bulb 5 is attached to the cell holder frame 4, in particular, to the mounting member 11. In other words, the mounting member 11 has an inner diameter slightly larger than the outer diameter of a base 14 of the bulb 5 but smaller than the outer diameter of a flange 15, as illustrated. Thus, the bulb 5 is fitted only at the base 14 into the mounting member 11 with the flange 15 engaging a front end face 16 thereof. On the other hand, the locking hook 13 is located at a position slightly projecting from the front end face 16 of the mounting member 11, so that the flange 15 can be positioned in between the front end face 16 and the locking hook 13.

It is to be noted that, while the mounting member 11 illustrated is in cylindrical in form, it is not limited thereto. In the present invention, it is sufficient that the front end face 16 of the member 11 (its shape is not necessarily limited to an annular one) is positioned in place to enable locking the flange 15 of the bulb 5.

The flange 15 for the bulb 5 is notched out at 17, for instance. Such a notch 17 is somewhat larger in size than the locking hook 13 so that, when the base 14 is fitted into the mounting member 11, with the notch 17 in coincidence with the locking hook 13, the flange 15 can reach the front end face 16. In such an arrangement, the base 14 is fitted into the mounting member 11, immediately following which the bulb is turned in either one of the lefthand or righthand direction to shift the position of the notch 17 relative to the locking hook 13, whereupon the flange 15 is put in between the front end face 16 and the locking hook 13. In this way, the bulb 5 is attached to the mounting member 11.

Figure 3:
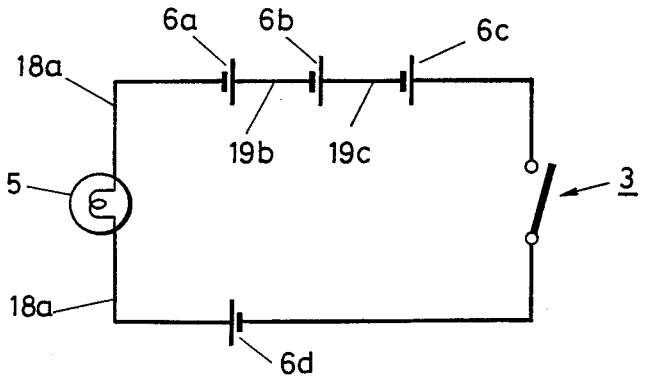
FIG. 3 is a circuit diagram of the embodiment of FIG. 1.
Figure 2:
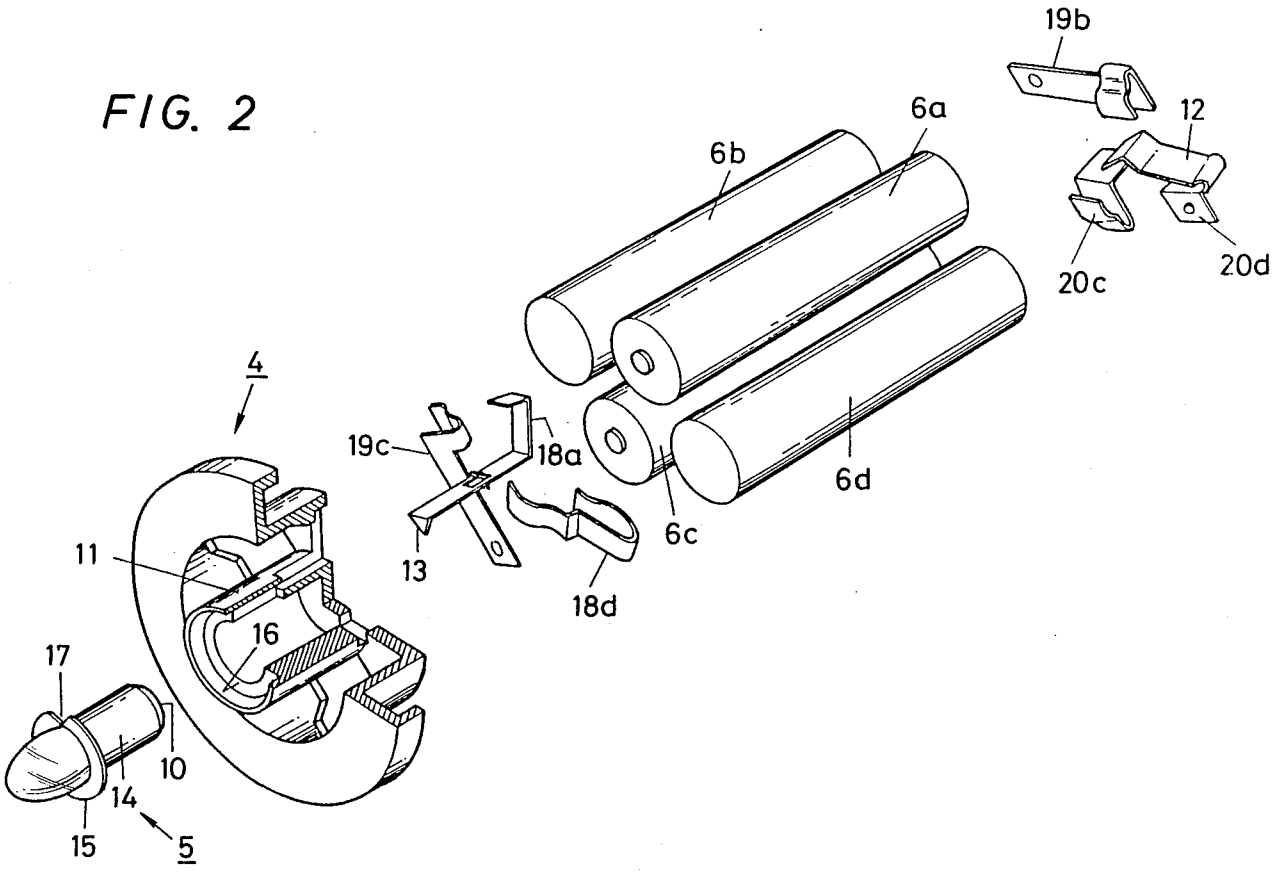
FIG. 2 is an exploded perspective view showing part of the embodiment of FIG. 1.
Figure 4:
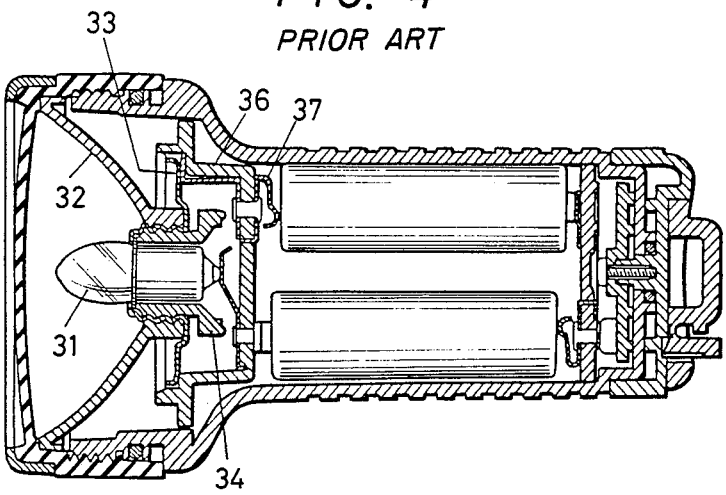
FIG. 4 PRIOR ART
FIG. 4 is a longitudinal side view showing one example of the prior art portable flashlight.
Figure 5:
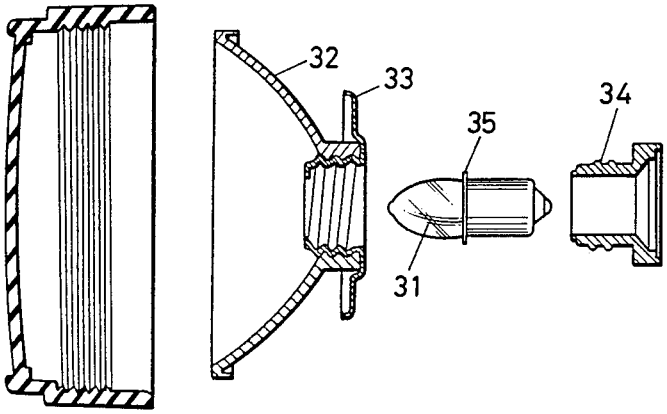
FIG. 5 PRIOR ART
FIG. 5 is a longitudinal side view showing part of the example of FIG. 4.

In one embodiment of the present invention as illustrated in FIG. 3, four dry cells 6a–6d are connected in series with the bulb 5 and the switch 3 being interposed between 6a and 6d, and 6c and 6d, respectively. Thus, the cell holder frame 4 includes a ground fitting 18a for making conduction between the flange 15 and the dry cell 6a, a ground fitting 18d for making conduction between a central contact 10 of the bulb 5 and the dry cell 6d, and a lead 19c for making conduction between the dry cells 6b and 6c. The body 1 is provided on the bottom face with a lead 19b for making conduction between the dry cells 6a and 6b, and a contact piece 12 for making conduction between the dry cells 6c and 6d.

It is of course to be understood that, in the foregoing embodiment, the locking hook 13 is made intergral with the ground fitting 18a, and is formed by bending inwardly an end portion of the latter.

According to the present invention described with reference to the preferred embodiment as illustrted in the accompanying drawings, any supporting fitting or socket for attachment of the bulb to the reflector is dispensed with, leading to a simplified structure and resulting in a reduction of the number of required parts and assembling steps and hence in the production cost. To add to this, the possibility that the socket, etc. may be lost during replacement of the dry cells is avoided from the standpoint of users.

Obviously, many modifications and variations of the present invention are possible in the light of above teachings. It is therefore to be understood that within the scope of the appended claims, the invention may be practiced othewise than as specifically described.

I claim:

1. A portable flashlight, comprising:

a body which receives dry cells therein;

a light source unit mounted on one end of the body, said light source unit having a reflector which has an insertion hole formed in a central portion thereof;

a bulb comprising a base and a flange, said flange completely circumscribing the base of the bulb and having a small notch formed therein; and bulb-holding means disposed within the body, said bulbholding means comprising a mounting member having an inner diameter which is larger than the outer diameter of the base of the bulb but smaller than the diameter of the flange, and an elongated ground fitting having first and second ends, said first end contacting one of the dry cells and said second end having a locking hook which projects slightly from a front end face of the mounting member;

the base of said bulb being axially insertable into the mounting member when said locking hook and said notch are in alignment so that the flange of the bulb abuts said front end face, the base then being rotatable so that the locking hook is not in alignment with the notch, wherein when the base is inserted into the mounting member, an end of the bulb projects through the insertion hole.

2. The flashlight as recited in claim 1, wherein said mounting member is in cylindrical form.

3. The flashlight as recited in claim 1, wherein said reflector is in parabolic form.

4. A structure for mounting a bulb in a portable flashlight, said flashlight comprising a body which receives dry cells therein and a light source unit mounted on one end of the body, said light source unit having a reflector which has an insertion hole formed in a central portion thereof, said bulb comprising a base and a flange, said flange completely circumscribing the base of the bulb and having a small notch formed therein, said structure comprising:

a bulb-holding frame for holding the bulb within the body, said bulb-holding frame comprising a mounting member having an opening and front end face formed at an end of the opening, the inner diameter of the opening being larger than the diameter of the base of the bulb but smaller than the diameter of the flange so that when the base is inserted into the opening, the flange rests against the front end face, and an elongated ground fitting having first and second ends, said first end contacting one of the dry cells and said second end having a locking means which projects from the front end face of the mounting member and has a locking hook which projects essentially parallel to the front end face, the distance between the locking hook and the front end face being slightly greater than the width of the flange.

5. A structure as claimed in claim 4, wherein said locking hook is dimensioned smaller than the notch in the flange.

6. A structure as claimed in claim 4, wherein said ground fitting is essentially L-shaped, a base leg of said L-shaped ground fitting constitutes said first end, and an end of a vertical leg of said L-shaped ground fitting constitutes said second end, and wherein said locking hook extends essentially perpendicularly from the vertical leg.

7. A flashlight as claimed in claim 1, wherein said ground fitting is essentially L-shaped, a base leg of said L-shaped ground fitting constitutes said first end, and an end of a vertical leg of said L-shaped ground fitting constitutes said second end, and wherein said locking hook extends essentially perpendicularly from the vertical leg.

8. A flashlight as claimed in claim 1, wherein said bulb-holding means further comprises an annular frame surrounding said mounting member and a plurality of radial webs connecting said annular frame to said mounting member.

* * * * *